US008610521B2

(12) United States Patent
Degner et al.

(10) Patent No.: US 8,610,521 B2
(45) Date of Patent: Dec. 17, 2013

(54) NOISE-SUPPRESSING ORBITAL RELAY ASSEMBLY

(75) Inventors: Brett W. Degner, Menlo Park, CA (US); Patrick Kessler, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 59 days.

(21) Appl. No.: 13/283,441

(22) Filed: Oct. 27, 2011

(65) Prior Publication Data

US 2013/0106540 A1 May 2, 2013

(51) Int. Cl.
*H01H 67/00* (2006.01)
*H01H 51/22* (2006.01)

(52) U.S. Cl.
USPC ..... 335/106; 335/102; 335/78

(58) Field of Classification Search
USPC ..... 335/78–86, 128, 104–106; 200/17 R
See application file for complete search history.

(56) References Cited

U.S. PATENT DOCUMENTS

| | | | | |
|---|---|---|---|---|
| 6,211,756 | B1 * | 4/2001 | Sun et al. | 335/4 |
| 6,693,248 | B1 * | 2/2004 | Schultz | 200/17 R |
| 7,679,012 | B2 * | 3/2010 | Liu et al. | 200/11 TC |
| 7,817,000 | B2 | 10/2010 | Rauh | |

FOREIGN PATENT DOCUMENTS

| | | | |
|---|---|---|---|
| CN | 85204343 | U | 11/1986 |
| JP | 6096822 | A | 4/1994 |
| KR | 100765616 | B1 | 10/2007 |

OTHER PUBLICATIONS

PCT Search Report; PCT Application No. PCT6/US2012/054294 Dated Feb. 20, 2013.
PCT Written Opinion of the International Searching Authority; PCT Application No. PCT6/US2012/054294 Dated Feb. 20, 2013.

* cited by examiner

*Primary Examiner* — Bernard Rojas
(74) *Attorney, Agent, or Firm* — Womble Carlyle Sandridge & Rice LLP

(57) ABSTRACT

An orbiting relay assembly may be provided that has one or more switches. The switches may be provided with electrical contacts. An actuator such as an electromagnetic actuator may rotate guiding structures such as a rotating yoke about a rotational axis. The guiding structures may have portions that receive movable electrical coupling structures such as metal balls or cylinders. There may be multiple movable electrical coupling structures in a relay. The electrical coupling structures may be distributed radially outwards from the rotational axis, may be distributed circumferentially about the rotational axis, or may be distributed axially parallel to the rotational axis. The guiding structures may be configured to place the switches in one or more different operating states by moving the metal balls or other movable electrical coupling structures about the rotational axis.

20 Claims, 14 Drawing Sheets

NOISE-SUPPRESSING ORBITAL RELAY ASSEMBLY

BACKGROUND

This relates generally to relays and, more particularly, to relays for use in electronic devices.

Relays are sometimes used to control the application of alternating current (AC) power. A traditional relay of this type contains an AC switch that can be alternately placed in an open or closed position using a solenoid. Conventional relay designs such as those based on slapping metal contacts are, however, bulky and noisy. Conventional relays may also be difficult to scale to provide additional switching capabilities.

It would therefore be desirable to be able to provide improved relay configurations.

SUMMARY

An orbiting relay assembly may be provided that has one or more switches. The switches may be provided with electrical contacts. A controllable actuator such as an electromagnetic actuator may rotate guiding structures such as a rotating yoke about a rotational axis. The guiding structures may have portions that receive movable electrical coupling structures such as metal balls or cylinders.

The movable electrical coupling structures may be used to make electrical connections between the electrical contacts for the switches. When, for example, a movable electrical coupling structure is moved into one position, the movable electrical coupling structure may be used to place a switch into a first operating state. When the movable electrical coupling structure is moved into another position, the movable electrical coupling structure may be used to place the switch in a second operating state. The rotating yoke or other guiding structures may be configured to move multiple electrical coupling structures simultaneously, so that the states of multiple switches in the relay can be configured simultaneously.

In configurations in which there are multiple movable electrical coupling structures in a relay, the electrical coupling structures may be distributed radially outwards from the rotational axis, may be distributed circumferentially about the rotational axis, and/or may be distributed axially parallel to the rotational axis.

Further features of the invention, its nature and various advantages will be more apparent from the accompanying drawings and the following detailed description of the preferred embodiments.

DETAILED DESCRIPTION

Electronic devices such as computers, displays, and other electronic equipment often contain alternating current (AC) to direct current (DC) power converter circuitry.

In some applications, it may be desirable to interrupt AC power flow to AC-to-DC power converter circuitry. For example, it may be desirable to use a relay to block the application of AC power to AC-to-DC power converter circuitry when the AC-to-DC power converter circuitry is not being actively used to convert AC power to DC power. Blocking the flow of AC power in this way may help reduce standby power losses. Relays may also be used to interrupt the flow of DC power and may be used in a wide variety of other circuit applications. Examples of circuit applications in which an orbiting relay is used as an AC relay are sometimes described herein as an example. This is, however, merely illustrative. Relays may be used as part of any suitable circuitry.

Figure 1:
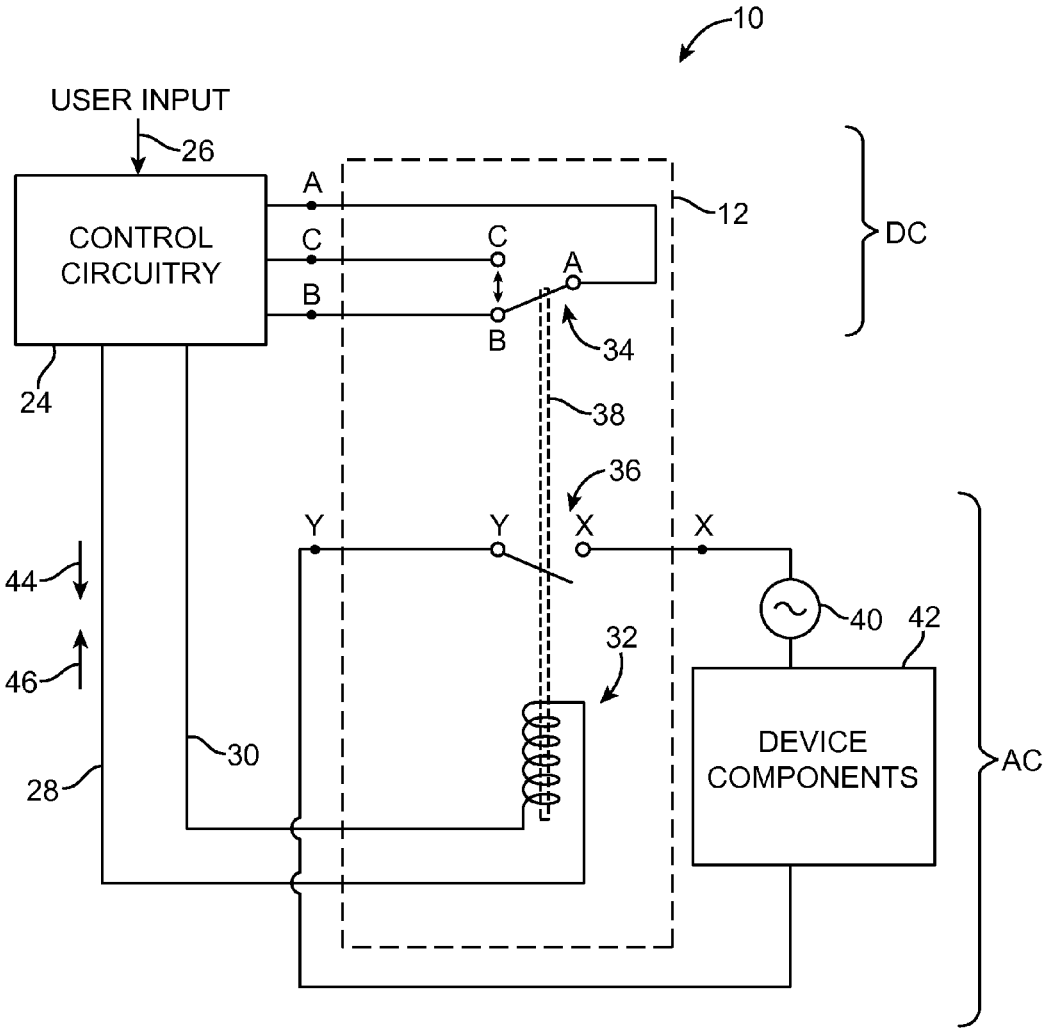
FIG. 1 is a schematic diagram of a system of the type in which an orbiting relay may be used in accordance with an embodiment of the present invention.

A system environment in which a relay such as an orbiting relay may be used is shown in FIG. 1. As shown in FIG. 1, equipment 10 may include a relay such as relay 12. Equipment such as equipment 10 may be incorporated into a computer, a display, a portable electronic device, or other suitable electronic equipment. In the example shown in FIG.1, equipment 10 has an alternating current section (AC) in which relay 12 is used to control the flow of AC power from alternating power source 40 to device components 42 and a direct current section (DC) in which control circuitry 24 uses DC signals to monitor the state of relay 12. Relays such as relay 12, may be used in other types of system environments if desired. The use of relay 12 in equipment 10 of FIG. 1 is merely illustrative.

Relay 12 may be, for example, an orbiting (rotating) relay that is controlled by a rotating electromagnetic actuator such as rotating solenoid 32 formed from a single coil of wire producing an efficient high-torque output or other suitable electrically controllable actuator. As shown in FIG. 1, relay 12 may have a first set of terminals associated with switch 34 and a second set of terminals associated with switch 36. The use of two switches in relay 12 is merely illustrative. In general, relay 12 may contain any suitable number of switch circuits.

Structures 38 may be used to couple switches such as switches 34 and 36 together. When solenoid 32 controls the position of structures 38, the positions of switches 34 and 36 are therefore changed simultaneously (in this illustrative configuration).

In the FIG. 1 example, the terminals associated with switch 34 include terminals A, B, and C. Control circuitry 24 may be used to monitor the state of switch 34 by applying DC signals across switch 34. The terminals associated with switch 36 include terminals X and Y. The state of switch 36 may be used to control AC power flow from AC line source 40 to device components 42.

The position of switches 34 and 36 may be controlled simultaneously using an electromagnetic actuator such as solenoid 32 to control the position of structures 38. Solenoid 32 may be a rotating solenoid (i.e., a rotating electromagnetic actuator). Control signals may be applied to solenoid 32 using a circuit formed from paths 28 and 30.

Relay 12 of FIG. 1 may have two different states. In a first state (shown in FIG. 1), switch 36 is in an open position, so that there is an open circuit between terminals X and Y. When switch 36 is open, switch 34 is in a position in which terminal A is shorted to terminal B. In a second state, switch 36 is closed and terminals X and Y are shorted together. When switch 36 is closed, switch 34 is in a position in which terminal A is shorted to terminal C instead of terminal B.

Control circuitry 24 may receive user input on path 26. User input may be provided using buttons, using an on-screen computer interface, using voice control, or using any other suitable user input interface arrangement.

Based on input such as user input 26 and/or other suitable switching criteria, control circuitry 24 may adjust the state of switch 36 using solenoid 32. When it is desired to place relay 12 and switches 34 and 36 in a first state (e.g., with switch 36 open), a control signal (e.g., a current) may be supplied to solenoid 32 in direction 44 (e.g., a positive current may be applied). When it is desired to place relay 12 and switches 34 and 36 in a second state (e.g., with switch 36 closed), a control signal of opposite polarity may be applied (i.e., a negative current flowing in direction 46 may be applied using paths 28 and 30).

Figure 2:
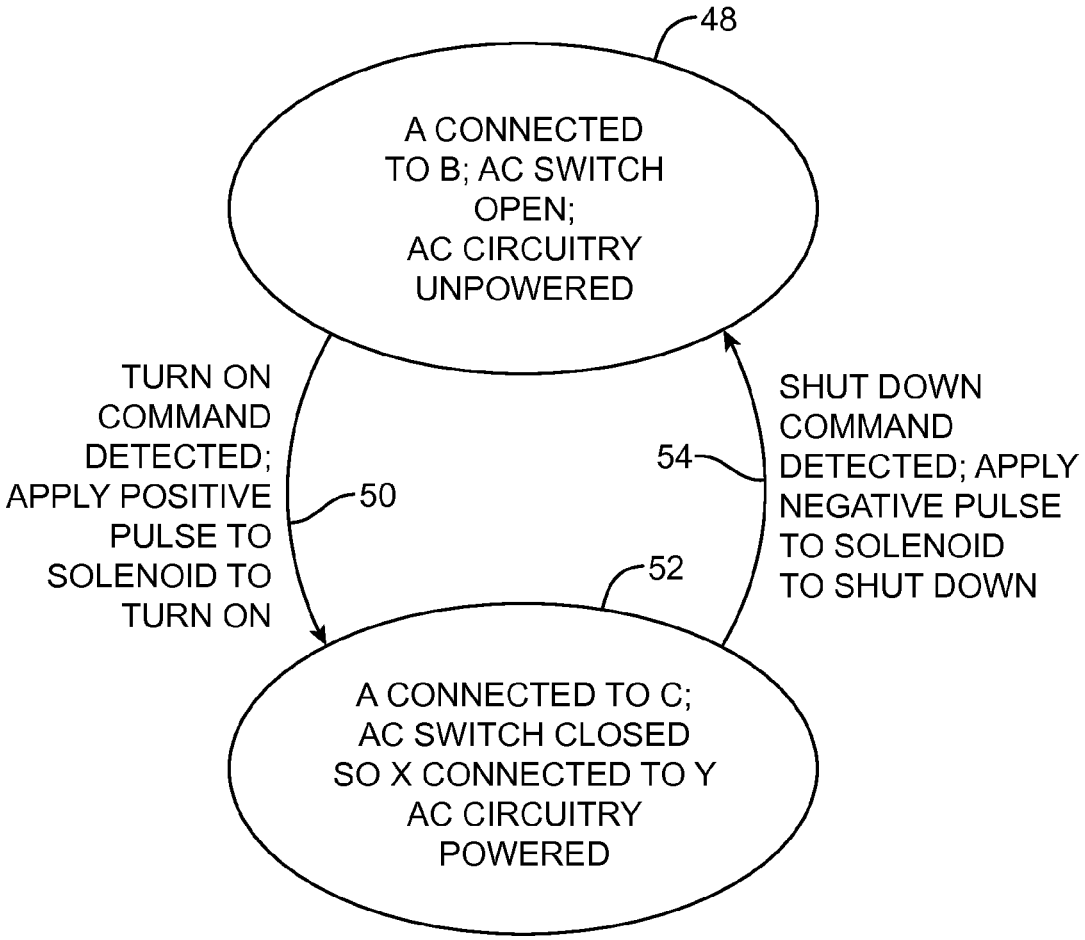
FIG. 2 is a state diagram showing how an orbiting relay may be placed in open and closed positions in accordance with an embodiment of the present invention.

FIG. 2 is a state diagram showing how a relay 12 may be switched between states 48 and 52. During the operations of state 48, relay 12 may be positioned so that terminal A in switch 34 is coupled to terminal B and so that terminals X and Y in switch 36 are disconnected. When used in equipment such as equipment 10 of FIG. 1, the open state of switch 36 can block AC current from flowing through device components 42 from AC source 40. During the operations of state 52, switch 34 is in a position in which terminal A is connected to terminal C and switch 36 is closed. With switch 36 closed, current can flow between terminals X and Y, so that AC power from AC source 40 may be used to power device components 42. Components 42 may include integrated circuits, sensors, status indicator lights, audio circuitry, display circuitry, AC-to-DC power converter circuitry, and other circuitry.

User input or other input may be used in controlling transitions between states 48 and 52. For example, control circuitry 24 may apply a positive pulse to solenoid 32 to move relay from state 48 to state 52 whenever control circuitry 24 detects that switch 34 is in a state in which terminals A and B are connected and a turn on command from a button has been received by control circuitry 24 or other suitable turn on criteria have been satisfied (see, e.g., line 50). Control circuitry 24 may apply a negative pulse to solenoid 32 to move relay from state 52 to state 48 whenever control circuitry 24 detects that switch 34 is in a state in which terminals A and C are connected and a turn off command from an on-screen user input command is received or other suitable turn off criteria have been satisfied (see, e.g., line 54).

Figure 3:
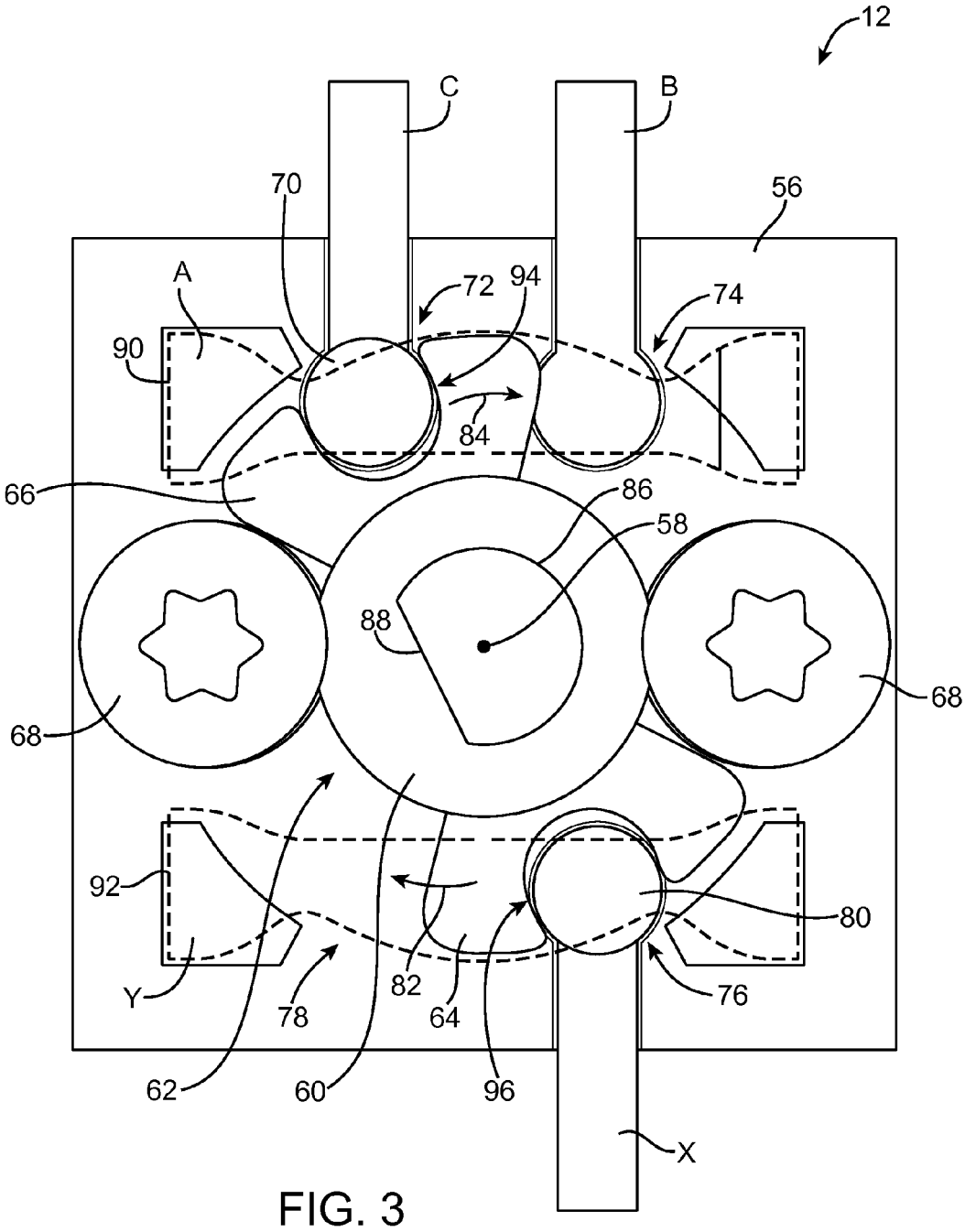
FIG. 3 is a top view of a portion of an orbiting relay in accordance with an embodiment of the present invention.

FIG. 3 is a top view of illustrative relay structures that may be used to implement a relay such a relay 12 of FIG. 1. As shown in FIG. 3, relay 12 may have movable electrical coupling structures such as balls 70 and 80. The movable electrical coupling structures may be formed from metal (e.g., copper, gold, copper coated with gold, etc.). If desired, cylinders or other rolling structures may be used to implement these moving switch structures. Arrangements in which relay 12 has balls such as balls 70 and 80 are sometimes described herein as an example.

Contacts such a contacts C, B, and X may be supported using a support structure such as base frame 56. Base frame 56 may be formed from a dielectric such as plastic, glass, ceramic, or other structure having an insulating surface. Contacts such as contacts C, B, and X may be formed from a conductive material such as metal. For example, contacts C, B, and X may be formed from a metal such as copper, gold, copper or other metals plated with gold or other metals, or other conductive material.

Screws such as screws 68 may be screwed into mating threads on the body of solenoid 32 (not shown in FIG. 3). Solenoid 32 may have a shaft such as shaft 86. The rotational position of shaft 86 about rotational axis 58 (i.e., the longitudinal axis of solenoid 32) may be controlled by applying control signals to solenoid 32 using paths such as paths 28 and 30 of FIG. 1. Shaft 86 may be coupled to structures such as yoke 62 for moving balls 70 and 80. To prevent undesirable rotational slippage between yolk 62 and shaft 86, shaft 86 and yoke body member 60 may be provided with mating engagement features. As shown in FIG. 3, for example, shaft 86 may be provided with one or more surfaces such as flat surface 88 and a mating opening in yoke body member 60 of yoke 62 may be provided with one or more mating flat surfaces. Engagement features of other shapes may be used if desired.

Yoke 62 may use recesses or other ball capture features to capture balls 70 and 80 (or other movable electrical coupling structures). Ball 70 may, for example, be captured in recess 94 in the upper portion of yoke 62, whereas ball 80 may be captured in recess 96 in the lower portion of yoke 62 (in the orientation of FIG. 3). Because recess 94 and recess 96 are formed within the same relay structure (i.e., yoke 62), the movement of recess 94 is coupled to the movement of recess 96 and the movement of ball 70 is coupled to the movement of ball 80. When yoke 62 is rotated clockwise, for example, recess 94 will move ball 70 in direction 84 from position 72 on contact C to position 74 on contact B, while recess 96 moves ball 80 in direction 82 away from position 76 on contact X to position 78.

Balls 70 and 80 may be used to form electrical paths for switches 34 and 36, respectively. Because the positions of balls 70 and 80 are determined by recesses formed in a common rotating structure (yoke body 60 of yoke 62), the position of ball 70 and therefore the state of switch 34 is coupled to the position of ball 80 and the state of switch 36, as described in connection with structure 38 of FIG. 1.

FIG. 3 shows the position of balls 70 and 80 when relay 12 is in its second state with contact A shorted to contact C and contacts X and Y shorted to each other. Contacts A and Y may be formed by conductive structures such as metal springs. The spring for contact A may be located above contacts B and C in the overlapping position indicated by dashed line 90. The spring for contact Y may be located above contact X in the overlapping position indicated by dashed line 92.

When relay 12 is in its second state (i.e., the state shown in FIG. 3), ball 70 is coupled between contact C and contact A, so that switch 34 is in a state in which contacts A and C are shorted together. At the same time, ball 80 is coupled between contacts X and Y so that switch 36 is in a state in which contacts X and Y are shorted together (i.e., switch 36 is closed).

When it is desired to place relay 12 in its first state (i.e., the state shown in FIG. 1), solenoid 32 may rotate shaft 86 and yoke 62 clockwise. The clockwise rotation of yoke 62 will move ball 70 in direction 84 until ball 70 leaves position 72 and comes to rest in position 74 over contact B. In position 74, ball 70 is coupled between contact B and contact A, so switch 34 is in its first state. The clockwise rotation of yoke 62 will simultaneously move ball 80 in direction 82 away from position 76 on contact X and into position 78. In position 78, ball 80 does not contact any metal contacts on base 56, so switch 36 is in its first state (i.e., switch 36 is open as shown in FIG. 1 and contacts X and Y are not electrically coupled by ball 80).

Switch contacts A, B, C, X, and Y may be held in fixed locations using base 56 and other relay contact support structures. Because contacts A, B, C, X, and Y are maintained in fixed locations relative to base 56 as balls 70 and 80 are rotated around rotational axis 58, a wiping motion may be produced between the surfaces of balls 70 and 80 and the corresponding surfaces of contacts A, B, C, X, and Y. This may help dislodge surface oxides and other surface materials that might impede the formation of satisfactory electrical contacts between the metal structures of relay 12. The wiping and rolling motions that are exhibited by balls 70 and 80 may help to suppress noise relative to conventional relay designs that use slapping metal contacts.

The rotational configuration of relay 12 may be used to create a balanced design in which components such as balls 70 and portions of yoke 62 are located on opposing sides of rotational axis 58. A balanced distribution of mass of this type in relay 12 may help reduce friction, may minimize noise and wear, and may otherwise improve relay performance. For example, the use of symmetrically distributed mass and evenly distributed frictional values may help enhance shock and vibration immunity, because external perturbations will not cause the relay to change positions. In arrangements of the type shown in FIG. 3 in which components for switch 34 such as ball 70 and contacts A, B, and C are located on one side of axis 58, whereas components for switch 36 such as ball 80 and contacts X and Y are located on an opposing side of axis 58 (180° away from the components of switch 34), different types of signals in relay 12 can be well isolated from one another. For example, in an environment of the type shown in FIG. 1, the DC signals associated with switch 34 can be well isolated from the AC signals associated with switch 36.

Figure 4:
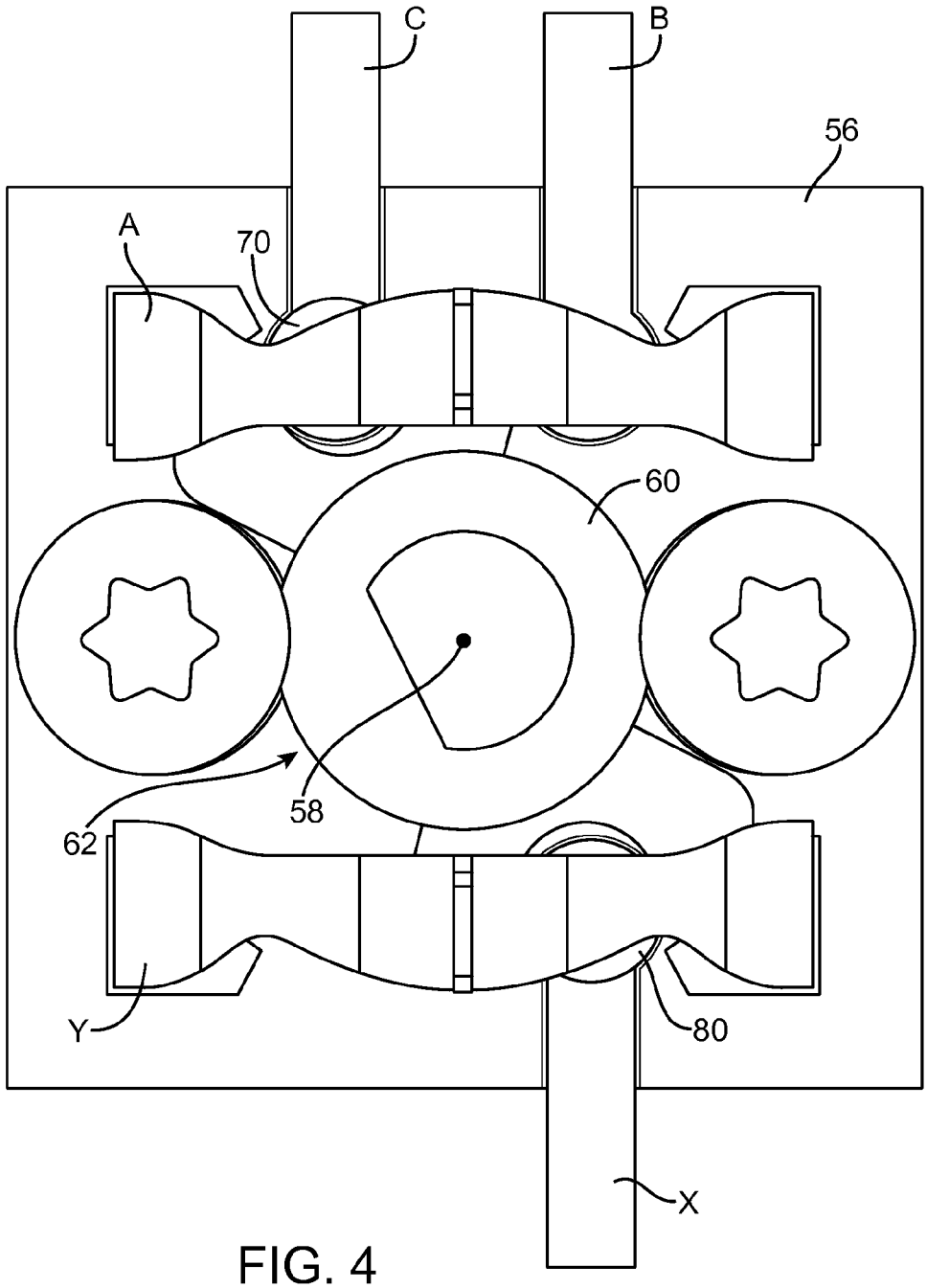
FIG. 4 is a top view of the relay shown in FIG. 3 in a configuration in which spring contacts are present in accordance with an embodiment of the present invention.

FIG. 4 is a top view of relay 12 of FIG. 3 in which electrical contacts (springs) A and Y are present. Springs such as springs A and Y may, if desired, be formed from a spring metal such as titanium copper, may be formed from other metals such as copper, or gold, or copper coated with gold, or may be formed from other suitable conductive material.

Figure 5:
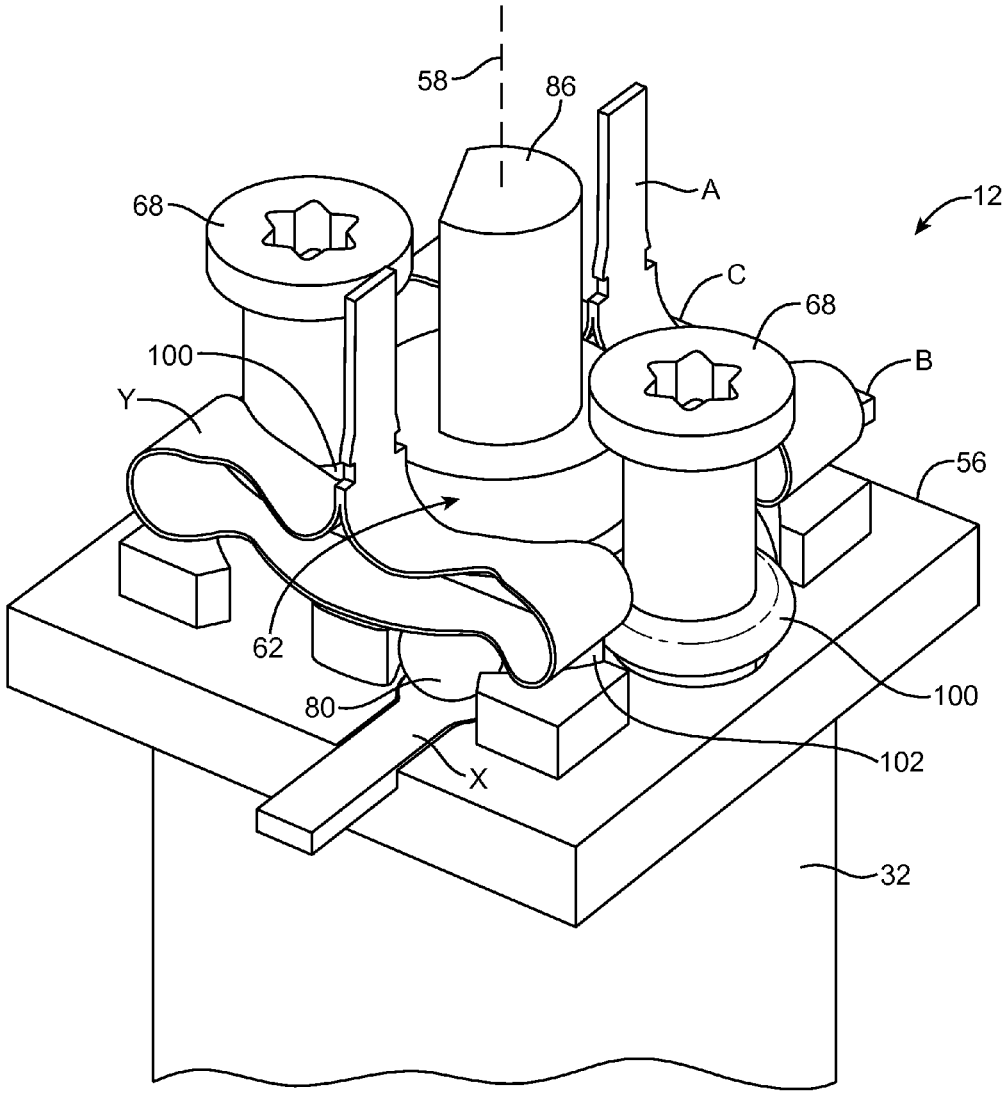
FIGS. 5, 6, and 7 are perspective views of the illustrative orbiting relay of FIGS. 3 and 4 in accordance with an embodiment of the present invention.
Figure 6:
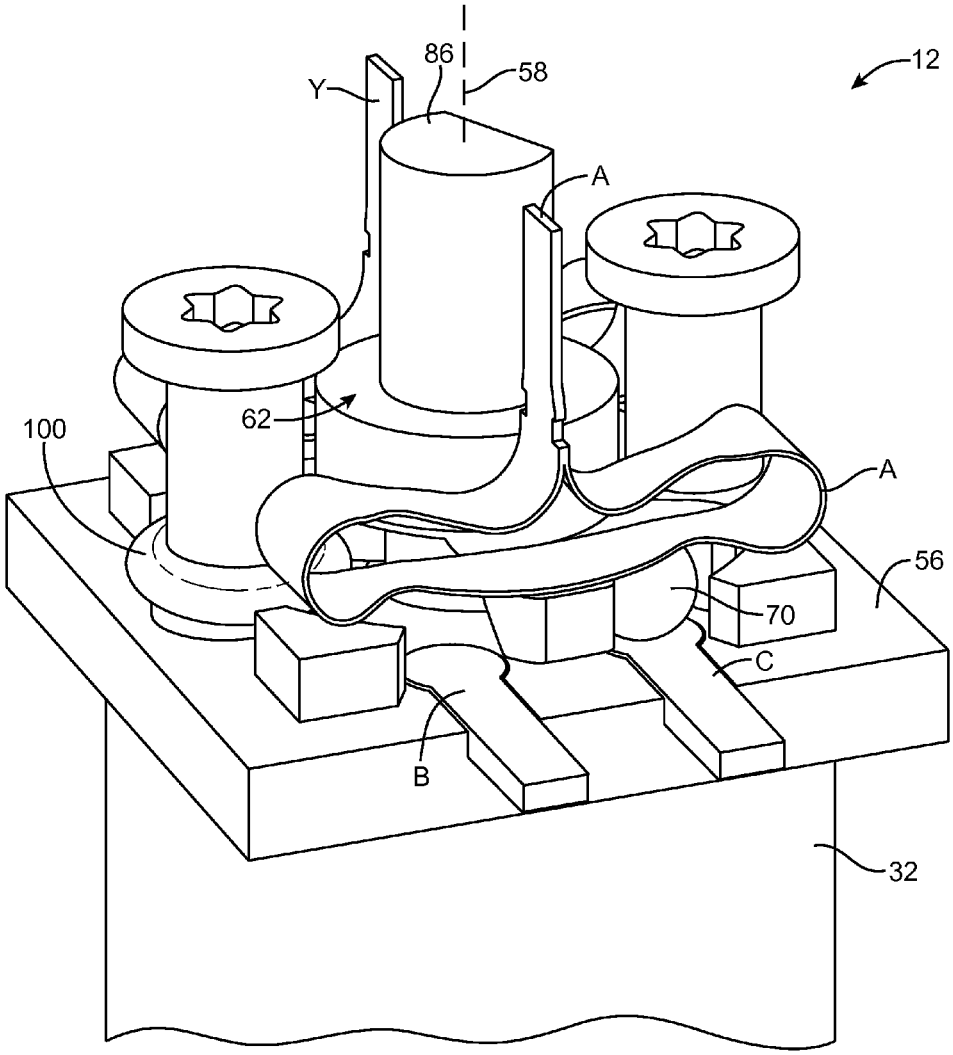

FIGS. 5 and 6 are perspective views of relay 12 of FIGS. 3 and 4. In FIG. 5, relay 12 is being viewed from the side of relay 12 closest to contacts X and Y. In FIG. 6, relay 12 is being viewed from the side of relay 12 closest to contacts A, B, and C.

As shown in FIG. 5, relay 12 may be provided with soft stop structures such as elastomeric rings 100 on screws 68. Rings 100 may be formed from a flexible polymer or other substance that is able to help absorb impact from portions of yoke 62 such as portion 102 of yoke 62 as yoke 62 is rotated about rotational axis 58. The presence of soft stop structures in relay 12 such as elastomeric rings 100 or other yoke cushioning structures may help reduce noise and vibration during use of relay 12.

Figure 7:
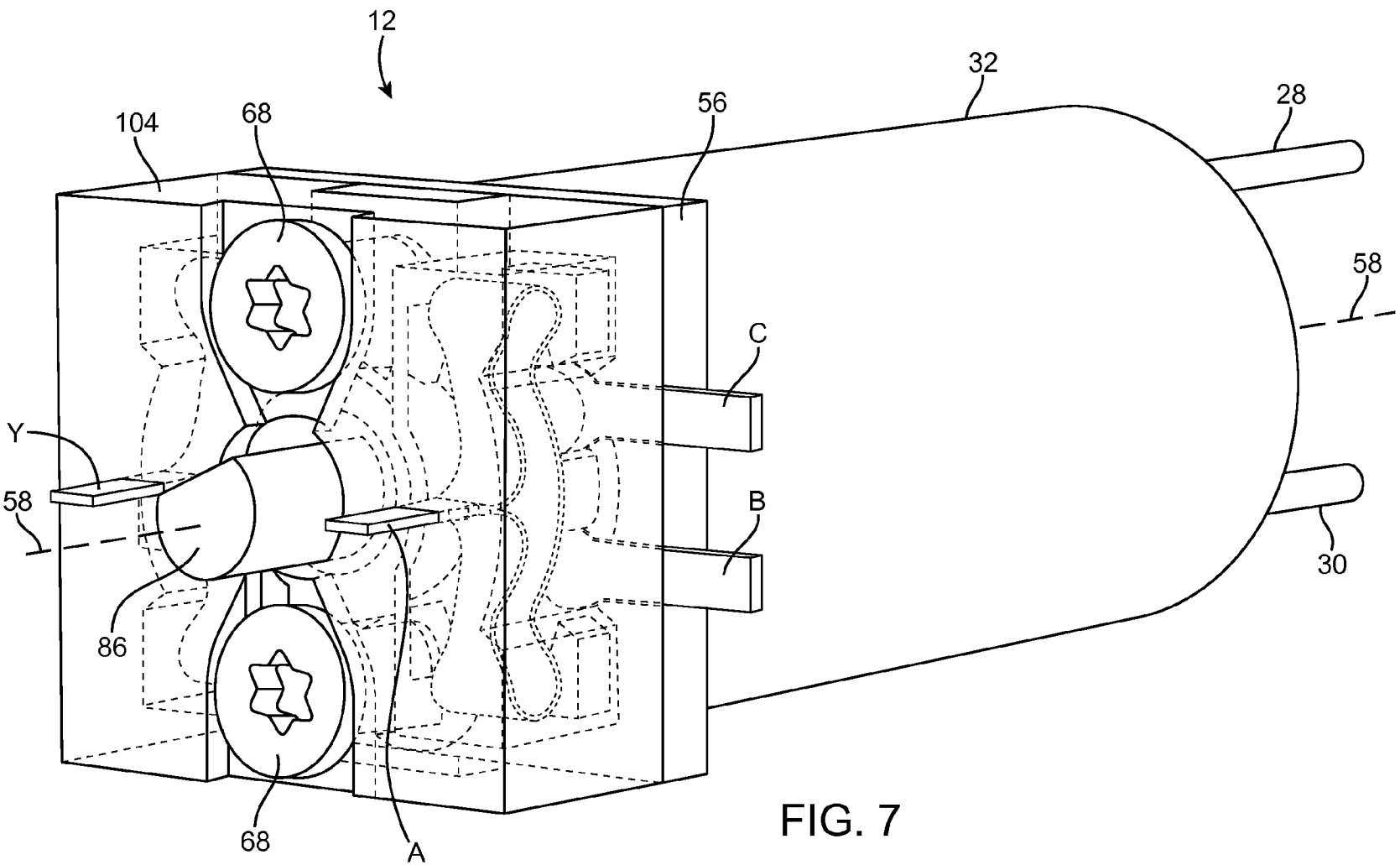

FIG. 7 is a perspective view of relay 12 showing how relay 12 may be provided with a cover structure such as cover 104. Cover 104 may be formed from plastic or other suitable materials. Cover 104 may be used to cover shaft 86 or, as shown in the illustrative example of FIG. 7, shaft 86 may protrude through an opening in cover 104. Cover 104 may be attached to base 56 using screws 68, snaps or other engagement features, adhesive, welds, or other suitable attachment mechanisms.

Figure 8:
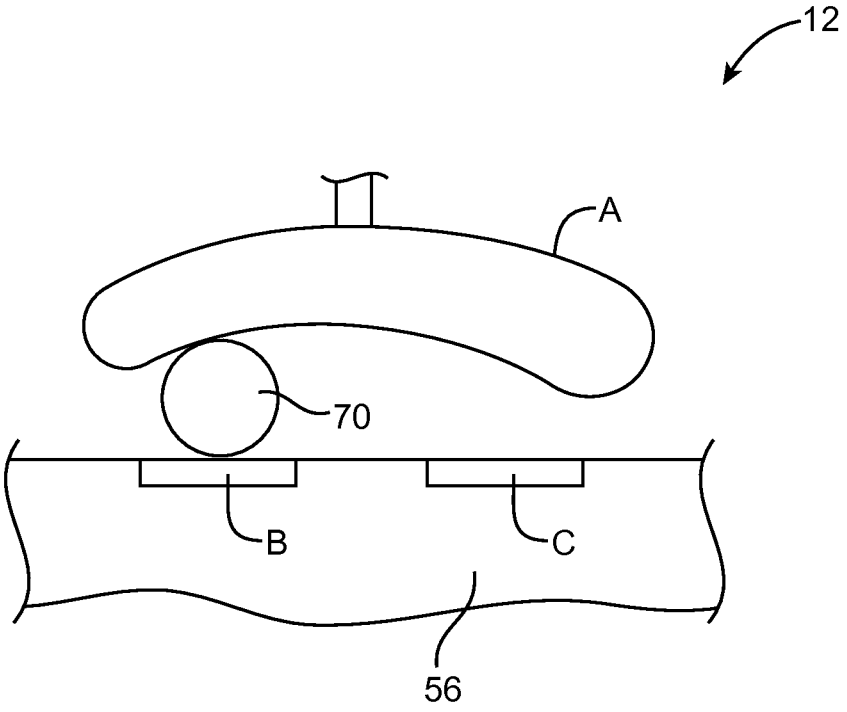
FIG. 8 is a side view of a portion of an orbiting relay showing how a ball may be used to form a short circuit connection between a spring contact and a selected one of two stationary contacts mounted on a support structure in accordance with an embodiment of the present invention.
Figure 9:
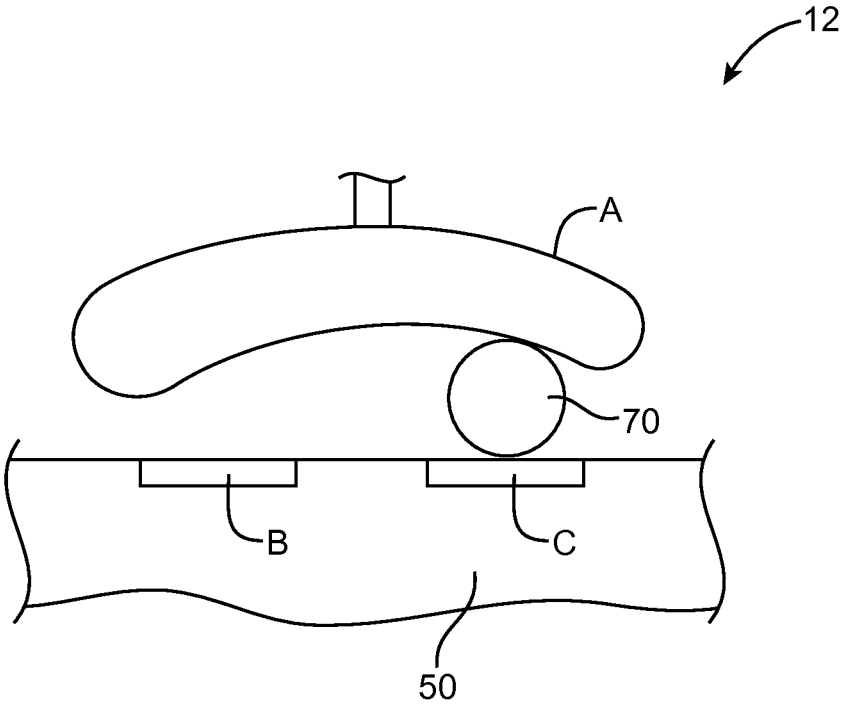
FIG. 9 is a side view of the portion of the orbiting relay of FIG. 8 in a configuration in which the ball has been used to form a short circuit between the spring contact and a different selected one of the two stationary contacts in accordance with an embodiment of the present invention.

FIGS. 8 and 9 are side views of portions of relay 12 showing how springs such as spring A (in the example of FIGS. 8 and 9) or other suitable contacts may flex to accommodate movement of movable electrical coupling structures such as balls (e.g., ball 70 in the examples of FIGS. 8 and 9). In the configuration of FIG. 8, ball (movable electrical coupling structure) 70 is located over contact B, so spring A has flexed upwards in the vicinity of contact B. In the configuration of FIG. 9, ball 70 has been moved to a position that is overlapping contact C. In the FIG. 9 configuration, spring A has flexed downward towards contact B (because ball 70 is no longer present over contact B) and has flexed upwards away from contact C (because ball 70 is interposed between spring A and contact C). The flexing of springs such as electrical contact spring A of FIGS. 8 and 9 and other electrical contacts in relay 12 may help to ensure a satisfactory contact wiping action during relay switching. The flexing of the springs helps to ensure that sufficient contact forces are maintained between ball, spring, and contact structures over a range of part tolerances, thereby ensuring satisfactory electrical performance. Flexing springs of the type shown in FIGS. 8 and 9 may also help to bias the ball in position, creating a bistable teeter-totter that makes the relay more robust to external perturbations.

Figure 10:
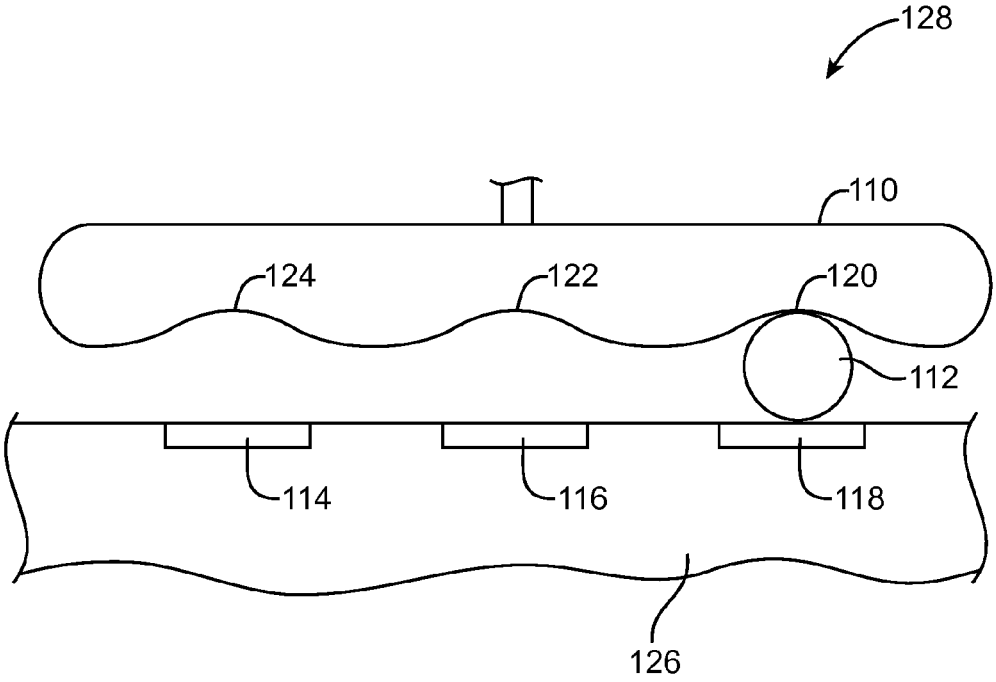
FIG. 10 is a side view of a portion of an orbiting relay having three possible ball positions and having three corresponding spring-based detents in accordance with an embodiment of the present invention.

If desired, orbiting relays may be provided with detent structures. A side view of a contact structure with detents is shown in FIG. 10. In the example of FIG. 10, relay structures 128 have been provided with contacts such as contacts 114, 116, and 118 that are mounted to base 126. Spring contact 110 has been used to form a switch terminal for relay structures 128. Ball 112 may be selectively coupled between spring 110 and contact 114, 116, or 118. Recesses in spring 110 such as recesses 120, 122, and 124 can be used to help to form detents for relay structures 128. For example, recess 120 may help hold ball 112 in position over contact 118, recess 122 may help hold ball 112 in position over contact 116, and recess 124 may help hold ball 112 in position over contact 114. The configuration of FIG. 10 involves the formation of three detents. Other numbers of detents may be formed in a rotating rely if desired. The example of FIG. 10 is merely illustrative.

Figure 11:
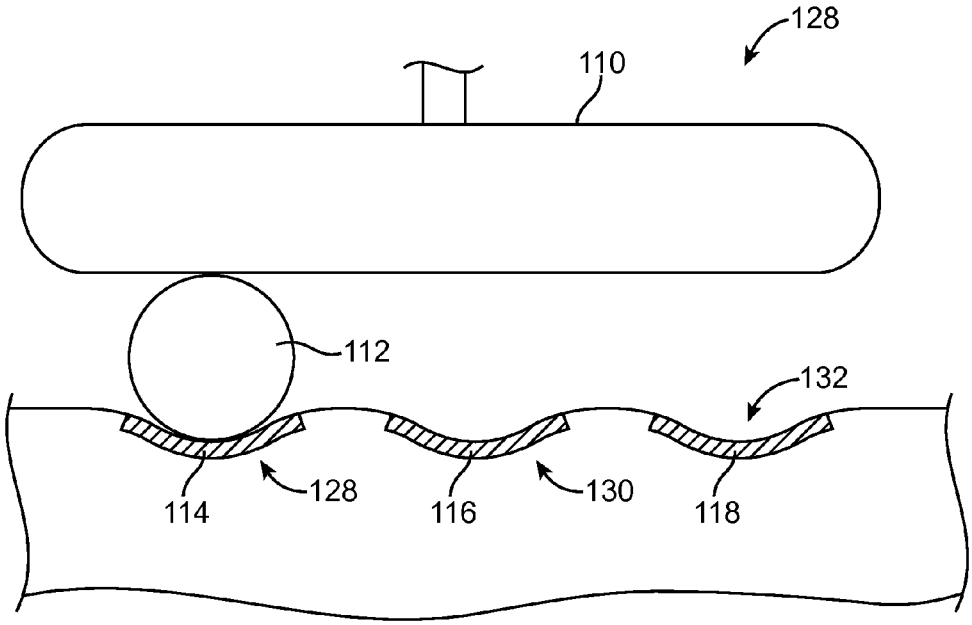
FIG. 11 is a side view of a portion of an orbiting relay having three possible ball positions and having three corresponding detents formed from recesses in the vicinity of three electrical contact locations in accordance with an embodiment of the present invention.

FIG. 11 shows how detents may be formed by mounting contacts 114, 116, and 118 within recesses 126, 128, and 130 in base 126.

The functionality of an orbiting relay such as relay 12 may be scaled by adding additional contacts. Electrical contacts may be used in forming switches with multiple positions (e.g., single pole multiple throw switches) and/or may be used in forming other types of switches. Relay 12 may contain one switch, two switches, three switches, or four or more switches (as examples).

Figure 12:
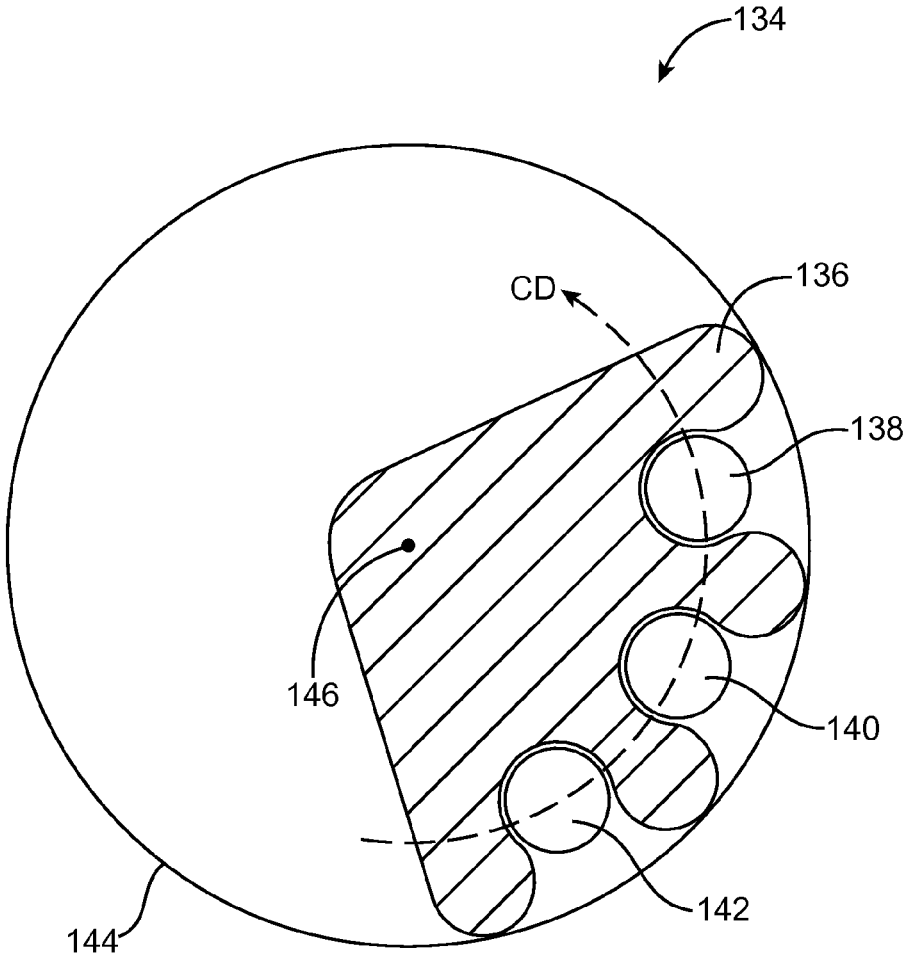
FIG. 12 is top view of a portion of an orbiting relay having multiple circumferentially distributed balls in accordance with an embodiment of the present invention.

FIG. 12 shows how a relay switch may be formed by circumferentially distributing multiple balls around yoke 136. As shown in FIG. 12, relay switch structures 134 may include relay base structure 144 (e.g., a plastic base). Yoke structure 136 or other suitable guiding structures may be mounted to a solenoid shaft so that yoke structure 136 may be rotated about rotational axis 146 (i.e., the longitudinal axis of the solenoid or other electromagnetic actuator). Circumferentially distributed recesses (recesses in a pattern that is distributed circumferentially along circumferential dimension C about axis 146) may be provided in yoke structure 136 to accommodate respective balls such as balls 138, 140, and 142.

Each of balls 138, 140, and 142 may be associated with one or more contacts. For example, each ball may be used to form an electrical connection between a first contact on base 144 and an overlapping spring or an electrical connection between a second contact on base 144 and the overlapping spring (e.g., when using the ball to form a two position switch such as switch 34 of FIG. 1) or may be used to form an electrical connection between a single contact on base 144 and an overlapping spring (e.g., when using the ball to form an opened/closed switch such as switch 36 of FIG. 1). Relays with any suitable number of circumferentially distributed balls or other coupling members may be used if desired. The example of FIG. 12 in which yoke 136 has been provided with three circumferentially distributed recesses to receive three corresponding balls is merely illustrative.

Figure 13:
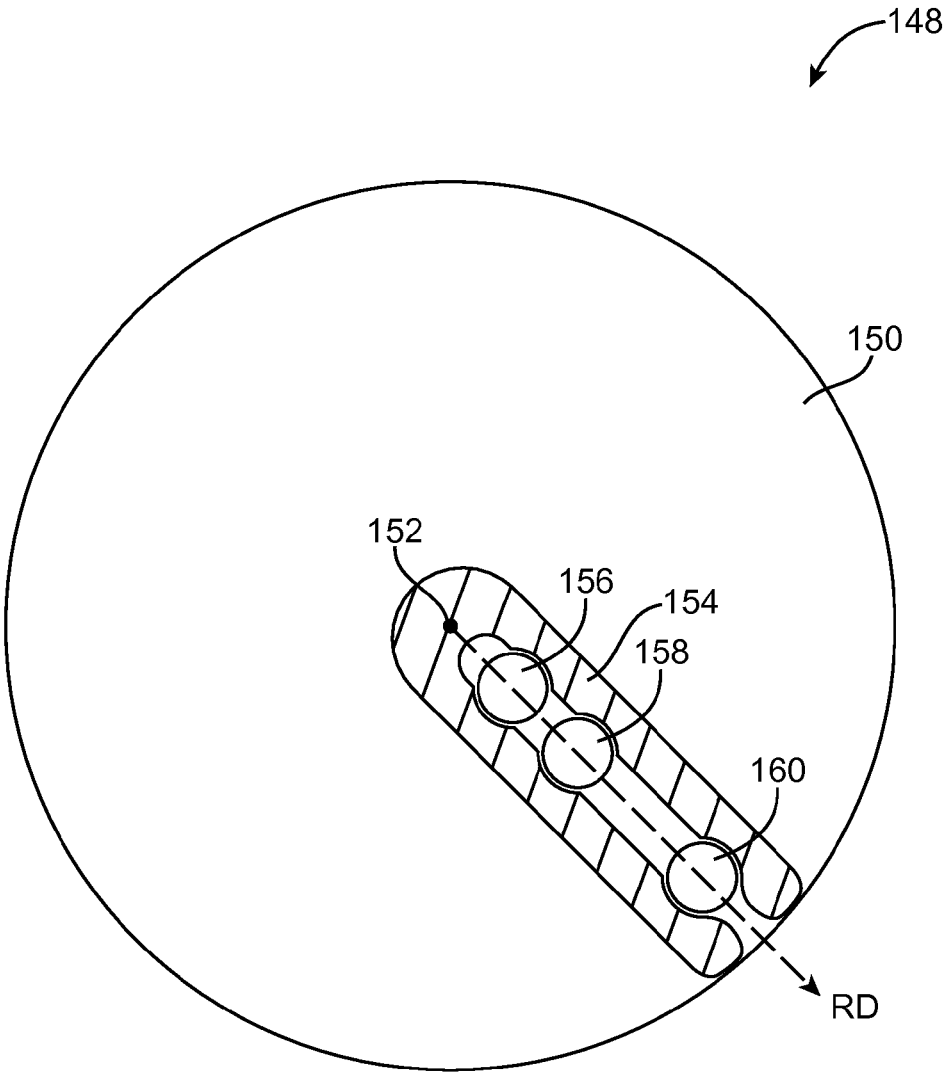
FIG. 13 is a top view of a portion of an orbiting relay having multiple radially distributed balls in accordance with an embodiment of the present invention.

FIG. 13 shows how a relay may be provided with additional switch functionality by radially distributing balls along radial dimension RD. As shown in FIG. 13, relay switch structures 148 may include relay base structure 150 (e.g., a plastic base). Yoke structure 154 may be mounted to a solenoid shaft so that yoke structure 154 may be rotated about rotational axis 152 (i.e., the longitudinal axis of the solenoid). Yoke structure 154 may be provided with a pattern of radially distributed portions such as radially distributed recesses (recesses distributed radially outward from axis 152 along radial dimension RD) to accommodate respective balls such as balls 156, 158, and 160.

Each of balls 156, 158, and 160 may be associated with one or more contacts. For example, each ball may be used to form an electrical connection between a first contact on base 150 and an overlapping spring or may be used to form an electrical connection between a second contact on base 150 and the overlapping spring (e.g., when using the ball to form a two position switch such as switch 34 of FIG. 1) or may be used to selectively form an electrical connection between a single contact on base 150 and an overlapping spring (e.g., when using the ball to form an opened/closed switch such as switch 36 of FIG. 1). Relays with any suitable number of radially distributed balls or other coupling members may be used if desired. The example of FIG. 13 in which yoke 154 has been provided with three (or more) recesses to receive three (or more) corresponding balls is merely illustrative.

Figure 14:
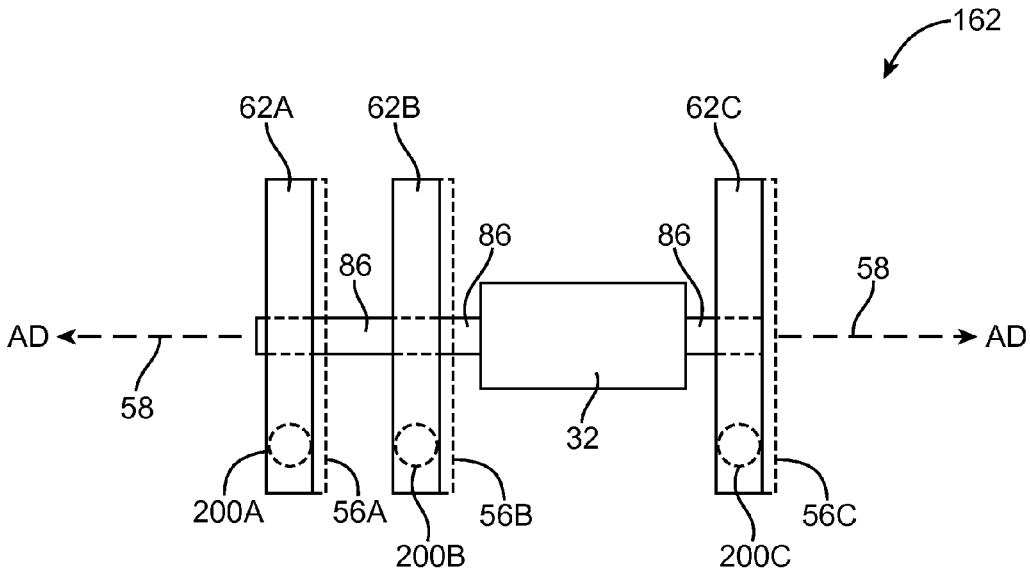
FIG. 14 is a side view of a portion of an orbiting relay showing how the relay may have axially distributed structures in accordance with an embodiment of the present invention.

FIG. 14 shows how a relay may be provided with additional switch functionality by axially distributing relay structures in an axially distributed pattern along axial dimension AD. As shown in FIG. 14, relay 162 may include switches formed from axially distributed electrical contacts, axially distributed guiding structures such as yoke structures 62A, 62B, and 62C, and axially distributed movable electrical coupling structures.

Relay structures 162 may, for example, include axially distributed relay yoke structures 62A, 62B, and 62C, each of which moves a respective ball (one of balls 200A, 200B, and 200C) relative to one or more electrical contacts on a respective base structure (a respective one of base structures 56A, 56B, and 56C). The yokes and bases are distributed axially along axial dimension AD (i.e., along yoke rotational axis 58, which is the longitudinal axis for an electromagnetic actuator such as solenoid 32). In the FIG. 14 example, there are two yoke structures located on one end of shaft 86 (the left hand end in the orientation of FIG. 14) and one yoke structure located on the other end of shaft 86 (the right hand end in the orientation of FIG. 14). This is merely illustrative. There may be one or more yoke structures (and corresponding base structures) located on only one end of shaft 86 or located on both ends of shaft 86.

In general, any suitable number of yoke and base structures may be controlled by solenoid 32. If desired, multiple techniques for creating additional switch functionality may be combined in a relay. For example, a relay may use any suitable number of axially distributed switch structures, any suitable number of circumferentially distributed switch structures, and/or any suitable number of radially distributed switch structures.

Orbiting relays of the type described in connection with FIGS. 1-14 may offer performance enhancements relative to alternative relay designs. For example, orbiting (rotating) relays may have scalable switching capabilities using axially distributed contacts, radially distributed contacts, and/or circumferentially distributed contacts. Switch structures can be balanced, so that equal or nearly equal amounts of mass are located on opposing sides of the rotational axis of the relay (distributed 180° circumferentially). Balanced mass distributions such as these may reduce friction and result in quieter and smoother operation. Balanced mass and friction may also improve immunity to shocks and vibrations by recuing the impact of external perturbations on rely performance. A wiping action may be produced at the electrical contacts of the relay as the balls or other moving contact coupling members slide across the surface of the relay contacts. The wiping and rolling actions of the balls may help reduce electrical contact resistances and may help suppress noise. Optional detents may be formed (e.g., as part of switch contact structures, as part of non-contact structures, etc.). Impact noise and vibrations may be minimized using soft stop structures (e.g., elastomeric rings or other yoke cushioning structures that guiding structures such as yoke structures may contact when rotated by an actuator). The use of a bistable rotating solenoid design enables reversible switching without complicated mechanisms. A rotating solenoid may also provide positional stability by the design of the windings and magnetic structures, ensuring proper switch function. A single coil of wire may be used in implementing the rotating solenoid and a small, efficient high-torque output may be produced. Orbiting relay assemblies may be used in electronic devices such as computers or other electronic equipment to block AC power delivery or to perform other switching functions.

The foregoing is merely illustrative of the principles of this invention and various modifications can be made by those skilled in the art without departing from the scope and spirit of the invention.

What is claimed is:

1. A relay, comprising:

electrical contacts;

a base configured to support at least one of the electrical contacts;

a rotating actuator having a rotational axis perpendicular to the base;

a shaft that is rotated by the rotating actuator;

at least one moving electrical coupling structure; and guiding structures that are rotated about the rotational axis by the shaft as the shaft is rotated about the rotational axis by the rotating actuator, wherein the guiding structures guide the at least one moving electrical coupling structure to at least one position in which the moving electrical coupling structure forms an electrical connection with at least one of the electrical contacts.

2. The relay defined in claim 1 wherein the electrical contacts include at least one spring.

3. The relay defined in claim 1 wherein the electrical contacts include at least one contact on one side of the rotational axis and at least one contact on an opposing side of the rotational axis.

4. The relay defined in claim 1 further comprising an elastomeric stop structure that the guiding structures contact when the guiding structures are rotated about the rotational axis.

5. The relay defined in claim 4 wherein the elastomeric stop structure comprises an elastomeric ring mounted to the base by a screw.

6. The relay defined in claim 1 wherein the moving electrical coupling structure comprises a metal ball.

7. The relay defined in claim 1 wherein the moving electrical coupling structure comprises one of a plurality of moving metal balls and wherein the guiding structures form a rotating yoke with portions that are configured in a circumferentially distributed pattern around the rotational axis to receive the plurality of moving metal balls in a circumferentially distributed pattern.

8. The relay defined in claim 1 wherein the moving electrical coupling structure comprises one of at least first and second metal balls, wherein the guiding structures are configured to form a yoke with a first portion that receives the first ball and a second portion that receives the second ball.

9. The relay defined in claim 8 wherein the electrical contacts include first, second, and third contacts on the base.

10. The relay defined in claim 9 wherein the electrical contacts include first and second springs, wherein the first ball is interposed between the first spring and the base for movement between a first position in which the first ball electrically couples the first contact to the first spring and a second position in which the first ball electrically couples the second contact to the first spring, and wherein the second ball is interposed between the second spring and the base for movement between a first position in which the second ball electrically couples the third contact to the second spring and a second position in which the third contact and the second spring are not electrically coupled by the second ball.

11. The relay defined in claim 10 wherein the rotating actuator is configured to simultaneously move the first and second balls.

12. The relay of claim 1 wherein the guiding structures comprise at least one recess to fit a conducting ball for electrically coupling a plurality of device components to a power supply and for electrically coupling two terminals in a control circuitry.

13. The relay of claim 12 further wherein the guiding structures comprise a plurality of recesses, each one of the plurality of recesses adapted to fit one of a plurality of conducting balls;

at least one conducting ball adapted to electrically coupling the plurality of device components to the power supply; and at least one conducting ball adapted to electrically coupling the two terminals in the control circuitry.

14. A relay, comprising:

at least a first switch having at least first and second operating states;

at least one metal ball in the first switch; and a rotating yoke that is configured to move the metal ball between a position that places the switch in the first operating state and a position that places the switch in the second operating state.

15. The relay defined in claim 14 further comprising:

an additional switch; and at least one additional metal ball in the additional switch, wherein the rotating yoke is configured to move the additional metal ball simultaneously with the first metal ball.

16. The relay defined in claim 15 further comprising an electromagnetic actuator configured to rotate the rotating yoke about a rotational axis, wherein the rotating yoke is configured to move the additional metal ball to adjust operation of the additional switch.

17. A relay, comprising:

an electromagnetic actuator;

a guiding structure that is rotated by the electromagnetic actuator; and first and second balls that are moved by the guiding structure.

18. The relay defined in claim 17, further comprising:

a support structure;

at least first and second electrical contacts on the support structure; and at least a third electrical contact, wherein the guiding structure is configured to move the first ball from a position in which the first ball electrically couples the first electrical contact to the third electrical contact and a position in which the first ball electrically couples the second electrical contact to the third electrical contact.

19. The relay defined in claim 18, further comprising:

at least a fourth electrical contact on the support structure and at least a fifth electrical contact, wherein the guiding structure is configured to move the second ball between a position in which the second ball electrically couples the fourth electrical contact to the fifth electrical contact and a position in which the fourth electrical contact and fifth electrical contact are not electrically coupled.

20. The relay defined in claim 19 wherein the guiding structure is rotated about a rotational axis, wherein the guiding structure comprises a yoke having first and second recesses on opposing sides of the rotational axis, and wherein the first ball is received within the first recess and the second ball is received within the second recess.

* * * * *